US011203820B2

(12) United States Patent
Ozden et al.

(10) Patent No.: US 11,203,820 B2
(45) Date of Patent: Dec. 21, 2021

(54) METHOD OF PRODUCING A YARN AND A FABRIC HAVING THE LOOK AND FEEL OF NATURAL FIBERS

(71) Applicant: Sanko Tekstil Isletmeleri San. Ve Tic. A.S., Bursa (AR)

(72) Inventors: Erdogan Baris Ozden, Bursa (AR); Ertug Erkus, Bursa (AR); Tuncay Kilickan, Bursa (AR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 145 days.

(21) Appl. No.: 16/041,943

(22) Filed: Jul. 23, 2018

(65) Prior Publication Data

US 2019/0024266 A1 Jan. 24, 2019

(30) Foreign Application Priority Data

Jul. 24, 2017 (EP) ..... 17182857

(51) Int. Cl.

| | |
|---|---|
| ***D01G 13/00*** | (2006.01) |
| ***D02G 3/04*** | (2006.01) |
| ***D02G 3/22*** | (2006.01) |
| ***D01H 4/16*** | (2006.01) |
| ***D01H 5/36*** | (2006.01) |
| ***D01D 5/42*** | (2006.01) |

(52) U.S. Cl.

CPC ..... *D01G 13/00* (2013.01); *D01D 5/423* (2013.01); *D01H 4/16* (2013.01); *D01H 5/36* (2013.01); *D02G 3/04* (2013.01); *D02G 3/22* (2013.01); *D10B 2201/28* (2013.01); *D10B 2331/04* (2013.01)

(58) Field of Classification Search

CPC ..... D02G 3/04; D02G 3/22; D01G 13/00

See application file for complete search history.

(56) References Cited

U.S. PATENT DOCUMENTS 2,271,184 A 1/1942 Dreyfus
3,107,412 A * 10/1963 Hall ..... D01G 1/10 19/0.46

(Continued)

FOREIGN PATENT DOCUMENTS

CN 103726151 4/2014

OTHER PUBLICATIONS

International Search Report and written opinion issued for corresponding International application No. PCT/EP2018/069878.

(Continued)

*Primary Examiner* — Shaun R Hurley
(74) *Attorney, Agent, or Firm* — Silvia Salvadori

(57) ABSTRACT

It is disclosed a method of producing a yarn having the look and feel of natural fibers, the method comprising the steps of preparing a first plurality of man-made textile fibers or a second plurality of natural textile fibers, the first and second plurality of textile fibers being obtained from breaking the first or the second textile fibers under the effect of a mechanical force applied to the first or the second textile fibers. A final blend for producing the yarn, can be prepared by adding the first plurality of textile fibers to a plurality of man-made fibers, or by adding the second plurality of textile fibers to a plurality of man-made fibers, or by adding the first plurality of textile fibers to the second plurality of textile fibers.

14 Claims, 4 Drawing Sheets

(56) References Cited

U.S. PATENT DOCUMENTS

| | | | | | |
|---|---|---|---|---|---|
| 3,945,188 | A | | 3/1976 | Muller | |
| 3,987,615 | A | | 10/1976 | Hill, Jr. | |
| 4,300,267 | A | * | 11/1981 | Winch | D01G 9/00 19/107 |
| 4,384,450 | A | | 5/1983 | Sawyer | |
| 4,446,237 | A | | 5/1984 | Berninger | |
| 5,155,989 | A | * | 10/1992 | Frey | D01G 13/00 57/327 |
| 5,331,801 | A | * | 7/1994 | Heifetz | D01G 11/00 19/107 |
| 9,133,570 | B2 | * | 9/2015 | Lightman | D01G 11/00 |
| 9,885,127 | B2 | * | 2/2018 | Lightman | D01G 11/00 |
| 2015/0159304 | A1 | * | 6/2015 | Schmitt | D02G 3/443 442/199 |

OTHER PUBLICATIONS

European Search Report and written opinion issued for EP priority application No. 17182857.7 (withdrawn).
European Search Report and written opinion dated Nov. 2, 2018 for corresponding EP application No. 18184992.8.

* cited by examiner

METHOD OF PRODUCING A YARN AND A FABRIC HAVING THE LOOK AND FEEL OF NATURAL FIBERS

RELATED APPLICATION

This application claims priority to European application no. 17182857.7 filed on 24 Jul. 2017, the contents of which are hereby incorporated by reference as if set forth in their entirety.

FIELD OF THE INVENTION

The present invention relates to a method of producing a yarn and a fabric having the look and feel of natural fibers.

BACKGROUND OF THE INVENTION

A known process that can be applied to man-made fibers, in order to obtain a yarn and a fabric having the look and handfeel of natural fibers, is texturisation. Texturisation is applied to man-made fibers in filament form to modify them in order to obtain a look and feel similar to the look and feel of natural fibers. Texturisation is a finishing step that transforms a pre-oriented supply yarn (POY) into Drawn Textured Yarn (DTY) and hence into a product having natural fiber-like character. During texturisation, pre-oriented yarn is permanently crimped using friction. Unfortunately it is not possible to apply a texturisation process to fibers in staple form.

Man-made fibers may be used either in filament or in staple form. When used in staple form, the fiber length is almost constant or in any case having a small coefficient of variation (CV %) of their length distribution, when compared with natural fibers. In general, natural fibers such as cotton, linen, and so on, exhibit a wide variety of fiber lengths.

In terms of using different length of fibers, it is known from document U.S. Pat. No. 4,466,237 to produce yarns made of a blend of synthetic fibers of different lengths with the aim of providing synthetic fiber-containing yarns and fabrics that have the appearance, the same level of comfort and physical characteristics of cotton or wool yarns and fabrics.

The yarns described in U.S. Pat. No. 4,466,237 comprise a blend of synthetic fibers. In particular, the yarns described therein comprise a mixture of at least three groups of synthetic fibers, each group consisting of synthetic fibers of a substantially uniform length which differs from the substantially uniform length of the synthetic fibers of the other groups.

In greater detail, each of the at least three groups differs from the substantially uniform length of the synthetic fibers in the other groups by a factor of at least about 15% and the fibers lengths within each group differ by a factor of 5% or less. None of the groups can be more than 75% by weight of the mixture.

A synthetic fiber-containing yarn which is said to exhibit the physical characteristics, such as bulkiness and appearance, of natural fiber-containing yarns is also described in U.S. Pat. No. 4,384,450.

However, the techniques described in U.S. Pat. Nos. 4,466,237 and 4,384,450 are not easy to be implemented and have not been well received by the industry. In particular, in document U.S. Pat. No. 4,466,237 it is stated that yarn production considerations (e.g., the problems which arise from handling multiple lengths of fibers) discourage the use of an excessive number of groups of synthetic fibers of differing lengths. Also, within each length group, there is almost no variation in fiber length (less then 5%) which makes the effect of such variation limited.

In general, in fact, such limitations influence negatively the natural look and feel of the fabric. Another disadvantage is given by the cost and complexity of cutting the fibers.

As mentioned above, it is known that the major fibers producers provide staple man-made fibers in a very limited number of length options.

Fibers cutting might be done by separate companies, but such operations will entail extra cost and will require more production time. Also arranging the percentages of the length groups adds another complexity. All this has the consequence that the lack of good distribution in fiber length will cause a less natural-like yarn aspect.

Document U.S. Pat. No. 2,271,184 describes a process for preparing synthetic staple fibers of such physical characteristics as to allow successful spinning of a mixture of staple fibers into a yarn having improved strength characteristics. Such document is exemplary of a prior art production technology that has been known for a long time.

Document U.S. Pat. No. 3,987,615 discloses a method of processing relatively inexpensive gin motes to reclaim the spinnable but normally waste cotton fibers contained therein and form a reduced cost yarn therefrom.

The object of the U.S. Pat. No. 3,987,615 patent is to treat inexpensive gin motes to reclaim the usable cotton fibers contained therein.

To obtain said result, U.S. Pat. No. 3,987,615 teaches to process the gin motes first by cleaning them, then carding them to provide a CV ranging from 45% to 60%, drafting them, and the combing them to further reduce the CV down to 30%-32%.

It is also known that noils are the waste fibers obtained from yarn production. In general, noils are the sort fibers left over from carding and combing process. For instance during the carding process, the fibers are aligned in a parallel fashion, the locks and unorganized clumps of fibers are opened mechanically. This mechanical force may break some the fibers and these shortened fibers are called noils.

SUMMARY

It is an aim of the present invention to provide a textile fabric comprised of a yarn containing man-made fibers and yarn having the look and feel on natural fibers.

This and other aims are achieved by a method of producing a yarn having the look and feel of natural fibers according to the present invention.

The method comprises the steps of:

preparing a first plurality of noils of man-made textile fibers and/or a second plurality of noils of natural textile fibers, providing a plurality of man-made fibers;

adding at least one of said first or second plurality of noils of textile fibers to the plurality of man-made fibers, or adding the first plurality of noils of textile fibers to the second plurality of noils of textile fibers, in order to obtain a final blend of fibers for producing the yarn, the final blend having a coefficient of variation (CV %) of the length distribution of fibers higher than the coefficient of variation (CV %) of the length distribution of the plurality of man-made fibers.

According to an embodiment of the method the length distribution of the fibers in the final blend of fibers is defined by a coefficient of variation (CV %) of at least 25 percent.

In an embodiment, the coefficient of variation of the length distribution of the fibers in the final blend of fibers for producing the yarn may have a value comprised between 25 and 80 percent. In a preferred embodiment, the coefficient of variation of the length distribution of the fibers in the final blend of fibers for producing the yarn may have a value comprised between 30 and 75 percent.

In another preferred embodiment, the coefficient of variation of the length distribution of the fibers in the final blend of fibers for producing the yarn may have a value comprised between 30 and 60 percent.

In another embodiment, the textile fibers used for producing the yarn, including said man-made fibers, comprise up to 100% of noils selected from noils of natural fibers, noils of man-made fibers, and mixtures thereof. In other words, the invention also comprises embodiments in which the totality of the fibers of the yarn is obtained from noils. Said noils preferably all have the mentioned CV % value of at least 25.

The invention provides several advantages over the prior art technique. A first advantage of the above method is that fibers which are used in yarn production, have different lengths, which creates a length-range which is similar to that of natural fibers.

Another advantage, in addition to the length-range advantage obtained by virtue of the use of noils, is given by the irregularity of the fiber shapes. Since noils are broken fibers, they do not resemble virgin fibers. As noils are pulled by the force applied, after being broken, they are more textured with respect to virgin man-made fibers, namely they have an appearance more similar to natural fibers, and have different edge-shapes. This amounts to a textured kind of fibers that have properties similar to those of the natural fibers.

During each yarn production process, a certain amount of noils is always produced. Since noils are considered waste products, reusing them could also be considered as a beneficial form of recycling. This fact is another important advantage of the present invention.

So apart from creating a yarn which can mimic a yarn made of natural fibers in a better, more cost-efficient and simpler way than the method described in U.S. Pat. No. 4,384,450, the present invention can recycle industrial waste. Another important advantage is given by the possibility of creating an alternative to natural fibers. Thanks to the present invention, a very simple way to produce textiles with very natural look, without using natural fibers, is provided.

Further objects of the present invention are a yarn as obtainable with the method of the invention, a fabric comprising said yarn and a garment comprising the fabric as above disclosed.

BRIEF DESCRIPTION OF THE DRAWINGS

The invention will now be described in greater detail with reference to the appended figures where.

DETAILED DESCRIPTION

Virgin Fibers

Figure 1:
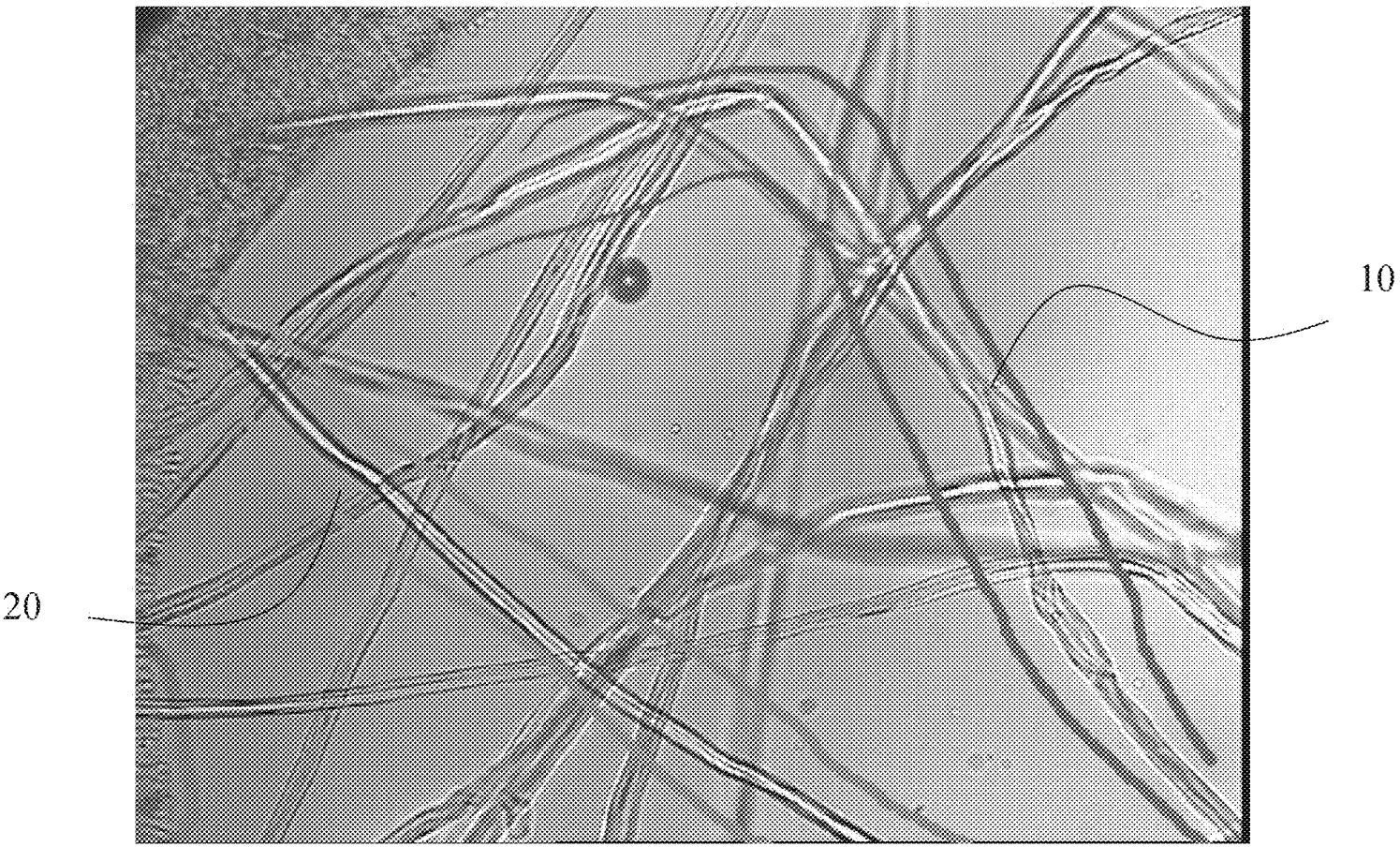
FIG. 1 is a representation of a mixed group of fibers comprising a textured fiber as an example of noil type of man-made fiber and at least a non-textured conventional man-made fiber for shape comparison.

For the present invention, the term "virgin fiber" indicates conventional man-made fibers. Such fibers have a substantially constant length within a very small range or in any case having a small coefficient of variation (CV %) of their length distribution. Virgin fibers may be any man-made fibers such as regenerated cellulosic fibers (lyocell, viscose, modal, bamboo, polynosic fiber, cupro, acetate, etc.), polyester, nylon and so on.

Man-Made Fibers

For the present invention, the term "man-made fiber" indicates any kind of fiber which is produced by human beings. This term includes all kinds of regenerated cellulosic fibers, organic fibers, inorganic fibers, metal fibers and so on.

Natural Fibers

All fibers obtained from vegetables or animals such as cotton, silk, wool, linen and so on are called natural fibers. A common point of natural fibers is that they are found in nature and are not produced by human beings.

Specifications of Noils

As stated above, noils are waste fibres deriving from industrial textile processes. During such processes, a certain amount of fibres are broken and those broken fibres are eliminated from the production and constitute noils. In embodiments, the length of the noils, i.e. of the fibers obtained from textile processes such as carding, is in the range of 4 to 38 mm.

In general, for the purposes of the present invention, noils of man-made fibers may be derived from operations of textile machines, such as yarn spinning machines or carding machines, or draw frames, namely machines for combining and drawing slivers of a textile fiber.

The skilled person knows that drawing is the operation by which slivers are blended, doubled and leveled.

In this sense, noils are fibers that have been subjected to a mechanical action. For example, the noils of viscose may have the specifications below defined in terms of average fiber length numberwise $L_n$.

Fiber Histogram (Numberwise)

| | |
|---|---|
| Average Fiber length (numberwise) | 29.4 mm |
| CV % | 34.8 |
| Short fiber content (less than ½ inch) % | 8.2 |

The same histogram test is applied to virgin viscose and results are indicated below.

Fiber Histogram (Numberwise)

| | |
|---|---|
| Average Fiber length (numberwise) | 33.6 mm |
| CV % | 24 |
| Short fiber content (less than ½ inch) % | 2.8 |

The above results are based on Uster Afis Pro 2 test.

In particular, the average fiber length numberwise $L_n$ can be calculated by the following formula:

$$L_n = \frac{\sum n_i l_i}{\sum n_i}$$

where:

$L_n$ is the average fiber length numberwise, $n_i$ is the number of fibers having length $l_i$ and $l_i$ is the length of the fiber i.

Also, as known in the art, the Coefficient of Variation (CV %) is the ratio between the standard deviation s of a distribution of measures and its average value $\bar{x}$, namely:

$$CV\ \% = \frac{S}{\bar{x}} * 100$$

Considering the above histograms, the data show high values of the Coefficient of Variation (CV %). Such data indicate that a wide range of length is present in the noils, a factor which enables a better duplication of natural fiber length distribution.

The difference in short fiber content and CV % shows the difference between noils with respect to virgin fibers in terms of noils having a wider range in fiber length.

It should also be considered that different machines or different settings on the same machine, or same settings but different fiber material and so on will have an influence at the length, shape and texture of noils.

Some machines may produce much shorter noils whereas some machines may produce longer noils.

As long as noils have a wide range of length and shape, these variations will not interfere with the scope of the present invention.

Table 1 below represents the standards of noils.

These results are based on Uster Afis Pro 2 test. If noils of any textile fiber have the specifications indicated in Table 1 below, they can be considered within the scope of the present invention.

TABLE 1

| | Average | Minimum | Maximum |
|---|---|---|---|
| Length (mm) | 24 | 4 | 38 |
| Length (mm) CV % | 45 | 25 | 80 |
| Short Fiber Content (less than ½") (%) | 20 | 5 | 65 |
| Neps Count (count/gram) | 175 | 50 | 300 |

Comparison in Yarn Form

Natural fiber containing yarns have higher irregularities which may be seen in test results like fine places, thick places, amount of neps, hairiness. Regular man-made fibers gives much less irregularities. That's why natural irregularities do not appear on the fabric surface. By adding noils to man made fibers, such irregularities will increase the possibility to achieve a more natural look.

Tables 2 and 3 show a comparison between a traditional yarn, indicated as Yarn 1, and a yarn which is made according to an embodiment of the invention, indicated as Yarn 2.

Yarn 3 which is a natural fiber yarn, namely it is composed of 100% cotton, is added in Tables 2 and 3 below for further comparisons.

The data provided in Tables 2 and 3 are obtained from Uster Imperfection Test Units where, in Table 2, EP stands for Effect Program according to which a particular slub pattern is made. The particular Effect Program used in Table 2 bis called Jap-39.

TABLE 2

| | Composition | Size | EP | U % | fine − 40 | fine − 50 |
|---|---|---|---|---|---|---|
| Yarn 1 | 100% modal | 10/1 | Jap-39 | 12.79 | 6 | 0 |
| Yarn 2 | 100% viscose noils | 10/1 | Jap-39 | 16.21 | 329 | 24 |
| Yarn 3 | 100% cotton | 10/1 | Jap-39 | 15.59 | 263 | 5 |

TABLE 3

| | Composition | coarse + 35 | coarse + 50 | Neps 200% | Hairiness |
|---|---|---|---|---|---|
| Yarn 1 | 100% modal | 1104 | 134 | 4 | 8.16 |
| Yarn 2 | 100% viscose noils | 2535 | 911 | 198 | 8.88 |
| Yarn 3 | 100% cotton | 2822 | 1087 | 29 | 8.77 |

From both Tables 2 and 3 above it appears clear that all irregularities such as fine places and coarse places, number of neps are very obviously increased in the case of Yarn 2 which is made of viscose noils. Here the U % parameter indicates the amount of irregularities. Yarn 2 has higher U % values than yarn 1 and similar U % values as yarn 3 which is made of cotton.

Besides, hairiness is also distinctively increased. The skilled person is aware that hairiness H corresponds to the total length of protruding fibers of 1 cm of yarn.

Also from both Tables 2 and 3 above it is apparent that the features of Yarn 2 are similar to the features of Yarn 3 which is a natural fiber yarn, namely it is composed of 100% cotton mentioned here for comparison.

Considering now FIG. 1, it is shown a representation of an embodiment of the invention consisting of a mixed group of fibers comprising textured and conventional man-made fibres.

The textured fiber appears more crimped and irregular with respect to the conventional man-made fiber.

Figure 2:
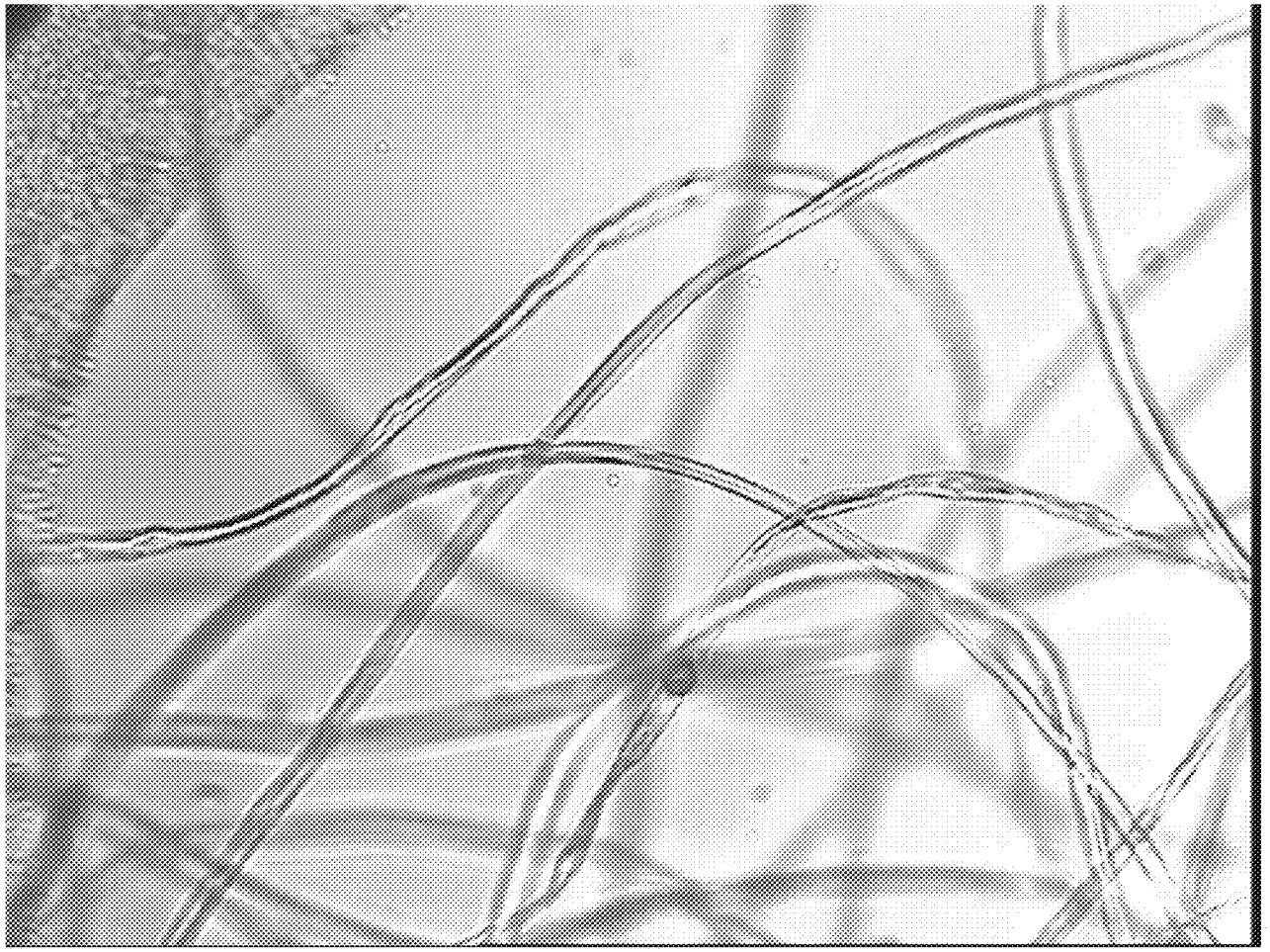
FIG. 2 is a representation of a group of man-made fiber noils wherein the textured fibers look almost like cotton fibers in terms of shape.

FIG. 2 is a representation of a group of man-made fiber noils.

FIG. 2 shows, in a better focus, how the fibers of noils are uneven and almost like cotton fibers whereas conventional man-made fibers are very even almost like a wire.

Figure 3:
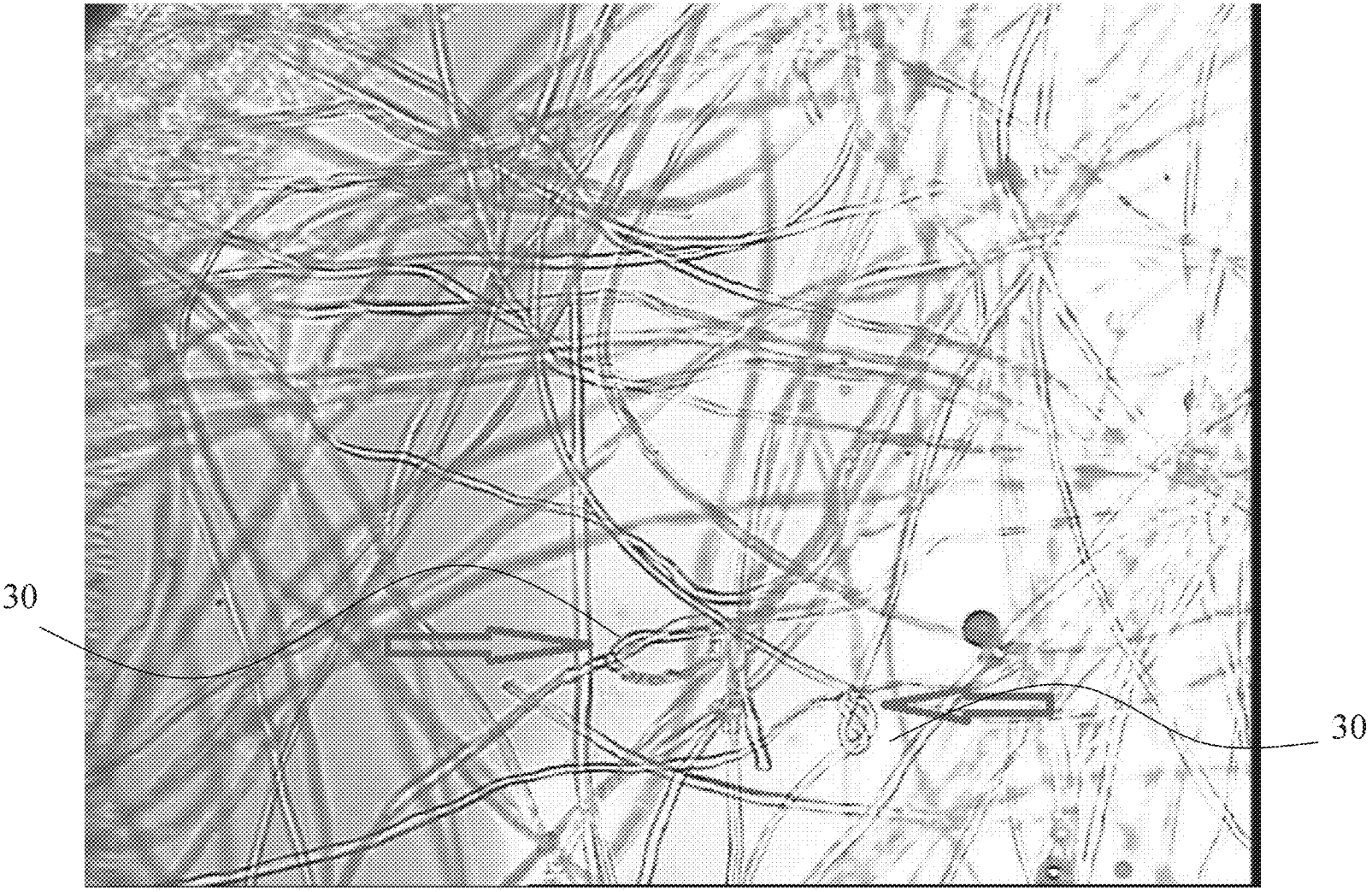
FIG. 3 is a representation of a group of man-made fiber noils having a certain number of fiber knots, these knots being similar to the ones of natural fibers and very rarely can be seen in man-made fibers.

FIG. 3 is a representation of a group of man-made fiber noils.

In this case, also some fiber knots can be seen.

Details about Noils of Man-Made Fibers

Noils could be made of man-made fibers available in staple form such as regenerated cellulosic fibers (lyocell, viscose, modal, acetate, bamboo, polynosic fiber, cupro and so on), polyester, nylon, or others.

Noils of different man-made fiber may also be mixed. For instance noils of viscose can be mixed with noils of lyocell. Noils of man-made fibers may be mixed with the virgin man-made fibers. In this case the minimum noil percentage should be 5%. Yarns may also be made of pure noils.

According to a further embodiment the use of fibers with different denier (fineness) and/or different cross-section shape (non-circular, irregular, etc.) is considered beneficial for the aims of the present invention.

This variation could be at the noils or the other fibers to be mixed with noils.

Noils may also be obtained from post recycled textile fibers. For example, if a textile product made of lyocell is recycled, the fibers which are derived from this recycling will not have a constant length or shape. Therefore such fibers will be like noils "uneven" in terms of length and shape.

Details about Noils of Natural Fibers

For the purposes of the present invention, also noils derived from natural fibers, such as cotton or wool or others, can be used. Such noils are already uneven in shape naturally and have a wide range of lengths. Therefore when noils derived from natural fibers are mixed with man-made fibers, a distinctively enhanced natural look may be achieved.

Also, noils of different types of natural and/or man-made fibers may be mixed together. Noils of natural and/or man-made fibers, may be mixed with the virgin man-made fibers wherein the noils percentage is at least 5% in weight with respect to the total weight of the yarn.

In an embodiment of the invention, the step of mixing together virgin man-made fibers with noils of natural and/or man-made fibers comprises mixing together fibers having different denier and/or different cross-section shape.

Additional Details

Yarns made by present invention could be used together with a yarn or yarns made of conventional fibers.

As it is known, slubs are irregularities made by purpose in certain length, thickness and frequency on yarns in order to achieve the look of the yarns produced in the past when yarn spinning was not capable of producing a very perfect or even yarn.

The slub effect is often being used to give an irregular look. In case of usage of noils, a more natural look is achieved. In particular, slubs create small, uncontrolled irregularities on the yarn which makes the look more natural. These small irregularities are not possible when a very even (by length, shape or fineness) fiber material is used.

Table 4 below shows a good comparison of slub parameter of the same three yarns which were compared before.

All three yarns were tested in the Amsler Laser Scanning Unit and results are shown below.

TABLE 4

| | Option | Average Thickness (%) | Average Length (mm) | Frequency (slub/meter) |
|---|---|---|---|---|
| Yarn 1 | 100% modal | 30 | 57 | 5.5 |
| Yarn 2 | 100% viscose noils | 36 | 72 | 6.3 |
| Yarn 3 | 100% cotton | 39 | 75 | 6.3 |

Average thickness shows the average increase in thickness vs. base of the yarn.

Average length shows the length of the slubs.

Frequency shows the number of the slubs per meter.

Checking all three parameters for the above three yarns, it is clear that yarn 2 looks much more similar to yarn 3 which is made of cotton, than yarn 1.

In order to make a comparison with the prior art note that in FIG. 1 a mixed group of fibers is a represented of comprising a textured fiber as an example of noil type of man-made fiber indicated with number 10 and at least a non-textured conventional man-made fiber indicated with number 20 for shape comparison, while FIG. 2 is a representation of a group of man-made fiber noils wherein the textured fibers look almost like cotton fiber in terms of shape. In FIG. 3 a group of man-made fiber noils is represented having a certain number of fiber knots 30, these knots 30 being similar to the ones of natural fibers and very rarely can be seen in man-made fibers.

Spinning

The yarns deriving from the above described embodiments and comprising noils of natural and/or man-made fibers may be spun into yarn by using any spinning technique such as ringspun, corespun, open-end spun, airjet spun or any possible spinning systems.

This innovative method is relevant for the yarns between Ne 3/1 and Ne 100/1.

Dyeing

A fabric and/or a garment made of a yarn and/or yarns which has been made using this innovative method can be used such as but not limited undyed, white, optic, yarn dyed, fiber dyed, piece dyed, fabric dyed, garment dyed, printed, coated in fabric and/or garment form with any kind of dyestuff/colouring agent such as indigo, indantrene, pigment, sulfur, reactive and so on.

Sustainability

As the noils are considered a waste, re-using them may be considered as recycling.

So, apart from creating a yarn which can better mimic a yarn made of natural fibers in more cost-efficient and simpler way with respect to the prior art, benefits can also be obtained by recycling so-called industrial waste.

Another important fact of the invention is the possibility of creating an alternative to natural fibers.

For instance, use of cotton is being extensively discussed nowadays from the point of view of sustainability. It is predicted that in the future the fields used for cotton cultivation will decrease because of the need of food for people and the need for water saving. In that case, man made fibers will be more and more utilized.

However the unnatural look and handfeel makes it difficult for the end-user to accept man-made fibers Thanks to the present invention, a very simple way to produce textiles without using natural fibers with very natural look is provided.

Since the present invention enables a yarn with wide range of fiber length and types, as well as protruding ends, beneficial properties such tactile comfort, covering, air permeability are much more evident. The yarn produced better mimics a yarn or fabric made of natural fibers.

The yarns produced can be used in weaving or knitting for producing a fabric having a more natural look and feel.

Garments comprising a fabric according to the various embodiments of the invention can also be produced.

Methods for Identification of a Product Made with the Innovative Method by Examining the Final Product There are different ways of identifying a product that has been made using the innovative method described with reference to the present invention by examining a final product.

1) Expert Judgment

As mentioned above, when this new technique is used, a fabric and/or a garment looks more natural than one of made by conventional man-made fibers. Therefore, when it is needed to check if a fabric and/or a garment is made by employing a yarn and/or yarns created by the innovative method described herein or not, the same type of product could be made in two reference versions.

The first version could be made by using natural fibers and the second version could be made by using conventional man made fibers. The first reference will, of course, represent the natural look of the fabric or garment.

Afterwards, a skilled person can check which of the references is more similar to the unknown fabric in order to determine if it is made with the new technique or not. The criteria to be used in general are: handfeel, surface irregularity, color and brightness.

2) Histogram Test

Another way to identify a product that has been made using the innovative method is related to the average fiber length and short fiber amount.

A yarn made with this new technique has much more shorter fibers than a yarn made by conventional man-made fiber, because as stated above in this new technique, noils are used.

In order to find out whether a fabric and/or garment is made with the innovative technique or not, the yarns could be taken out from the fabric and/or the garment and then these yarns could be untwisted.

By untwisting the sample, free fibers will be obtained which can then be put into a histogram machine to identify the average fiber length and the short fiber content.

Obviously if there is a higher amount of short fiber and lower average fiber length in comparison to those of the yarn which is made out of conventional man-made fiber, it means that the yarn tested has been produced by the innovative technique described herein.

In order to have a secure decision, two reference yarns can be provided as before explained: the first sample being made by using natural fibers and the second sample being made by using conventional man made fibers and both samples could also be untwisted and be subjected to the histogram test.

By using these two reference histogram tests, the skilled person may form an idea about an unknown yarn's production technique.

If the unknown yarn's fiber has a short fiber amount and average fiber length similar to the first reference, it means that there are noils in the content of the unknown yarn and therefore the tested yarn is made employing the innovative technique described in the present invention.

3) Microscope Analysis

Yarns can be checked using a SEM (Scanning Electron Microscope) microscope to find out whether they are made by this innovative technique or not.

When noils are used, it is expected to see a lot of floating fibers. When conventional man-made fibers are used, not many floating fibers can be seen, rather it is expected to see more parallel, uniform regular fibers.

Figure 4:
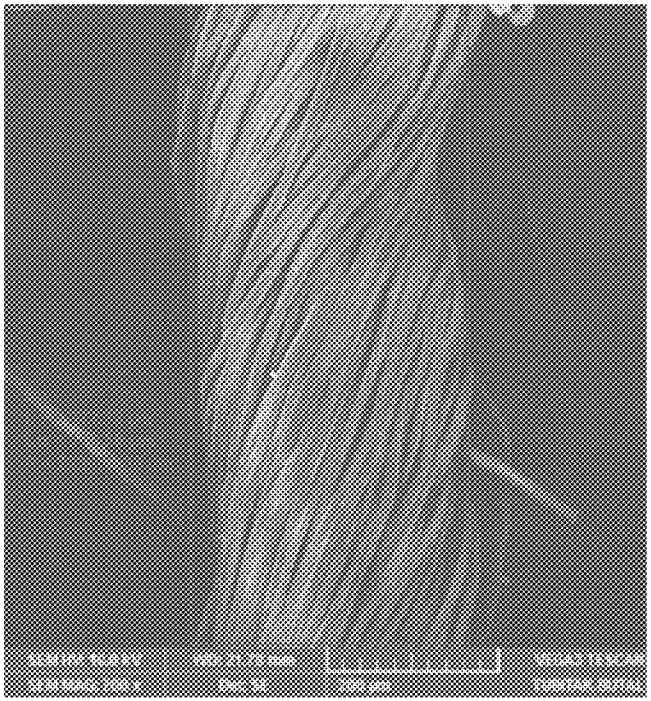
FIG. 4 is a representation of a yarn made of 100% conventional modal in Ne 8/1 Ring spun.

For example FIG. 4 is a representation of a yarn made of 100% conventional modal in Ne 8/1 Ring spun. For comparison, FIG. 5 is a representation of a yarn made of 100% noils in Ne 8/1 Ring spun.

Figure 5:
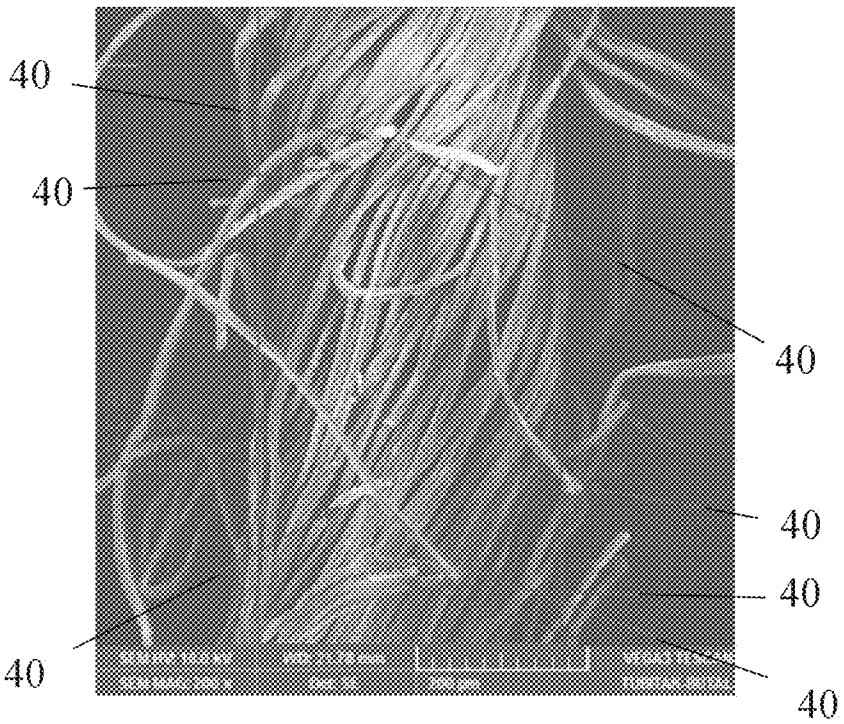
FIG. 5 is a representation of a yarn made of 100% noils in Ne 8/1 Ring spun.

FIG. 4 and FIG. 5 help to check the floating fibers.

FIG. 4 shows mostly parallel, uniform fibers while FIG. 5 shows floating fibers with irregular shapes.

FIG. 4 and FIG. 5 allow to make a comparison by counting the number of the fiber edges 40 on the yarn surface also.

Simply when shorter fibers are used, it is expected to see a greater number of fiber edges 40 on the yarn surface.

To verify this, a 3 cm yarn is checked with microscope.

The idea is to see and capture some pictures where the greatest amount of yarn edges are present.

The places where no and/or few edges can be seen should be ignored.

Basically, the average of the number of the edges of minimum 4 pictures can be taken where the greatest number of yarn edges 40 can be seen.

To be able to have this minimum four pictures, at least 12 pictures have to be taken (ratio is 1:3). Out of those minimum 12 pictures, minimum 4 of them are selected which have the maximum amount of fiber edges and then the average number of fiber edge is calculated from those selected pictures.

Using these pictures, also the yarn surface in terms of square meters can be checked using, for example the unit $mm^2$.

So to calculate the ratio of interest, the number of edges 40 are divided by the surface (in $mm^2$).

Table 5 below is a chart showing the limits of ring spun yarns.

TABLE 5

| Material | Number of edges/$mm^2$ minimum | Number of edges/$mm^2$ maximum |
|---|---|---|
| 100% cotton | 20 | 30 |
| 100% man-made fiber noils | 20 | 27 |
| 50% man-made fiber, 50% man-made fiber noils | 16 | 23 |
| 100% modal | 5 | 16 |

An increase in the amount of noils will increase the number of the edges. The higher the amount of noils in a certain tested composition, the higher will be the number of the edges 40.

In order to capture best pictures, it's better to use a yarn before finishing process or a yarn portion which has the minimum damage. For instance, a denim fabric could be stone washed and this may have an influence on the yarn surface which makes it difficult to see the yarn edges as the fibers are fibrillated. In this case yarn sample should be taken where there is the least damage.

Ring spun yarns respond best to this analysis. Whereas OE, airjet type of spinning techniques are more difficult as the fibers are very much compact and it is hard to see them under microscope. Also compact spinning technique would also insert the fiber edges into the yarn so that a lower number of edges can be seen, but in any case, the unknown yarn can be analyzed under a SEM microscope in terms of yarn edge number and floating fiber to be compared with reference yarns. As above, a first sample is made by using natural fibers and the second sample being made by using conventional man made fibers. In case there is an influence of the dyestuff, fabric finishing or garment finishing, the number of the edges 40 may be calculated as out of the tolerances stated here. In this case, same as stated above, reference fabrics/garments should be made from yarns (a first sample being made by using natural fibers and a second sample being made by using conventional man made fibers) and should be treated/dyed in the same way as the unknown sample to be compared with the unknown fabric and/or garment.

When noils of natural fibers are used with man-made fibers, reference yarns help to figure out the number of yarn edges 40. For instance if cotton noils are mixed with modal, the number of the edges 40 of this yarn will be greater than the number of edges 40 of a yarn made of conventional cotton with the same modal fibers. Also the number of floating fibers would be higher.

It is also possible to use image processing libraries currently available, such as, but not limited, to OpenCV or alike in order to evaluate and rank automatically the fiber edges generated by microscopy such as electron microscopy for finer details in comparison with the one made of conventional man-made. Such an application can count the edges within the image frame along the yarn and assign numerical values to samples for quantitative comparison and ranking. As long as the samples are prepared in the same way and are imaged under the same viewpoint and magnification, numerical values can be used for quantitative comparison or for benchmarking. Same as above, here the numeric values of the inventive product will be similar to that of the natural fibers.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way.

Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. A method of producing a yarn, the method comprising the steps of:

preparing a plurality of noils of man-made textile fibers, wherein the content of fibers whose length is less than ½" in said plurality of noils of man-made textile fibers is at least 5%;

providing a plurality of man-made fibers in staple forms;

adding said plurality of noils of man-made textile fibers to the plurality of man-made fibers in staple form, in order to obtain a final blend of fibers for producing the yarn, the final blend having a coefficient of variation (CV %) of the length distribution of fibers higher than the coefficient of variation (CV %) of the length distribution of the plurality of man-made fibers in staple form.

2. The method according to claim 1, wherein the length distribution of the fibers in the final blend of fibers is defined by a coefficient of variation (CV %) of at least 25 percent.

3. The method according to claim 1, wherein the textile fibers used for producing the yarn, including said man-made fibers in staple form, comprise up to 100% of noils of man-made textile fibers.

4. The method according to claim 3, wherein the noils of said plurality of noils of man-made textile fibers have a length comprised between 4 and 38 mm.

5. The method according to claim 3, wherein the noils of said plurality of noils of man-made textile fibers have a short fiber content comprised between 5 and 65 in percentage.

6. The method according to claim 3, wherein the noils of said plurality of noils of man-made textile fibers have a neps count between 50 and 300 count/gram.

7. The method according to claim 3, wherein the noils of said plurality of noils of man-made textile fibers are noils of man-made fibers in staple form.

8. The method according to claim 7, wherein the noils of said plurality of noils of man-made textile fibers are chosen from at least one of the following fibers: viscose, lyocell, modal, cupro, polynosic fiber, acetate, polyester, nylon or propylene.

9. The method according to claim 1, wherein the coefficient of variation (CV %) is calculated as a function of the numberwise average fiber length ($L_n$) of the textile fibers.

10. The method according to claim 1, wherein, in said step of preparing a plurality of noils of man-made fibers, noils of different man-made fibers are mixed together.

11. The method according to claim 1, wherein, in said step of adding said plurality of noils of man-made textile fibers to the plurality of man-made fibers in staple form, virgin man-made fibers in staple form are added to said plurality of noils of man-made fibers, said noils of man-made textile fibers representing at least 5% in weight with respect to the total weight of the yarn.

12. The method according to claim 11, wherein said virgin man-made fibers in staple form and said noils of said plurality of noils of man-made textile fibers have different denier and/or different cross-section shape.

13. The method according to claim 1, wherein a further step of creation of slubs in the yarn is provided.

14. The method according to claim 1, wherein the noils of said plurality of noils of man-made textile fibers have a length comprised between 4 mm and 38 mm, a short fiber content comprised between 5 and 65 in percentage, a neps count between 50 and 300 count/gram and a coefficient of variation (CV %) of the length distribution between 25 and 80 in percentage.

* * * * *